US005382313A

United States Patent [19]

Eminger

[11] Patent Number: 5,382,313

[45] Date of Patent: Jan. 17, 1995

[54] SUBLIMATION TRANSFER APPARATUS

[76] Inventor: Michael F. Eminger, 2896 Unaweep Ave., Grand Junction, Colo. 81503

[21] Appl. No.: 665,415

[22] Filed: Mar. 5, 1991

[51] Int. Cl.[6] ..... B30B 15/34

[52] U.S. Cl. ..... 156/583.1; 156/579; 269/271

[58] Field of Search ..... 156/583.1, 581, 579, 156/228; 269/268, 270, 271, 279, 266, 269, 280, 281, 282, 283, 284, 224, 254 CS, 267

[56] References Cited

U.S. PATENT DOCUMENTS

| | | | |
|---|---|---|---|
| 2,874,751 | 2/1959 | Norton | 269/224 X |
| 3,813,268 | 5/1974 | Kerwin | 156/542 X |
| 4,739,682 | 4/1988 | Birkestrand | 269/284 X |
| 4,753,629 | 6/1988 | Powell et al. | 156/583.1 X |
| 4,804,433 | 2/1989 | Smith | 156/359 |
| 4,874,454 | 10/1989 | Talalay et al. | 156/359 |
| 4,943,684 | 7/1990 | Kramer | 427/287 X |
| 5,019,193 | 5/1991 | Aramini | 156/64 |

*Primary Examiner*—David A. Simmons
*Assistant Examiner*—J. Sells
*Attorney, Agent, or Firm*—Donald W. Erickson

[57] ABSTRACT

Sublimation transfer apparatus of the type using a heated solid head which is adaptable to print on cylindrical objects of varying diameters and, yet, providing sufficient and uniform distribution of pressure is described. A solid head in which metal inserts matching the curvilinear surface of the head to permit the head to accept cylindrical objects of varying diameter is described. An apparatus which is usable on different size cylindrical objects by the mechanism of spring tension elements in cooperation with the solid head is described.

1 Claim, 4 Drawing Sheets

SUBLIMATION TRANSFER APPARATUS

BACKGROUND OF THE INVENTION

This invention relates to apparatus useful for sublimation printing. Sublimation printing wherein there is used transfers bearing sublimable dyes for decorating coffee mugs, tumblers and other cylindrically shaped items, that have been pre-coated with a polymeric material capable of receiving and retaining sublimation dyes, has become increasingly popular. Typical of the apparatus, polymeric coatings, dyes, transfer medium and methods used in sublimation printing are described by Durand, U.S. Pat. No. 4,174,250, Haigh, U.S. Pat. No. 4,202,663, Deroode, U.S. Pat. No. 4,314,814, Talalay et al., U.S. Pat. No. 4,874,454 and Kramer, U.S. Pat. No. 4,943,684.

In the practice of sublimation printing, it is very important to have the properties of sufficient pressure and uniformly distributed pressure adjacent the transfer medium in order to obtain imprints of high quality. This is especially important for the transfer of sublimable dyes from a transfer produced by still video printers because the dyes are more difficult to sublime. In sublimation transfer apparatus using solid heads to accomplish the transfer of the dye onto a pre-coated mug or other cylindrical item, generally, the apparatus can provide the required sufficiency of and unformity of pressure; however, it can accept only one size cylinder. This lack of versatility is a serious drawback or limitation because so many cylindrically shaped items such as mugs do not have a standardized diameter. Sublimation transfer apparatus is oftentimes used at the point of purchase and the proprietor needs apparatus that will easily accommodate various sizes of cylindrically shaped items such as mugs which can vary in diameter by an inch or more depending upon the style of the mug and manufacturer. At the same time, the apparatus needs to be capable of providing sufficient or adequate pressure which is uniformly distributed adjacent the transfer sheet in order to obtain high quality imprints. The foregoing needs are met by means of the present invention.

SUMMARY OF THE INVENTION

In one embodiment of the present invention, there is provided one or more pairs of inserts which can be detachably or releasably fitted to the curvilinear cavity of the solid head of a sublimation transfer apparatus in order to adapt or change the apparatus from printing one size of cylinder to another. By having inserts of various wall thickness such as about 0.063 inch to 0.125 inch, the versatility of the transfer apparatus is increased to the extent that most all popular or common coffee mugs can be accommodated with one sublimation transfer apparatus.

In another embodiment of the invention, there is provided spring tensions means for use with a sublimation transfer apparatus whereby there is obtained sufficient and uniform distribution of pressure between the curvilinear surface of the solid head, the transfer sheet and the outside surface of the cylindrically shaped item such as a mug during imprinting.

DETAILED DESCRIPTION OF THE INVENTION

Figure 1:
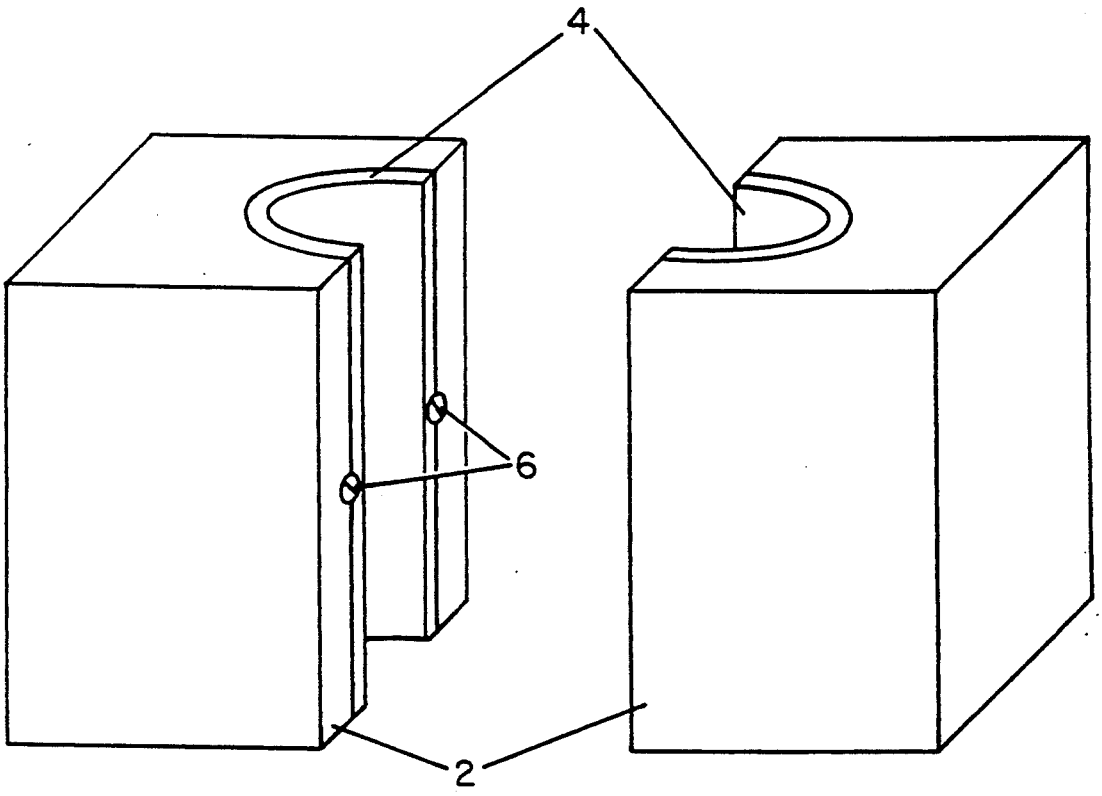
FIG. 1 is an upper side perspective view of a solid head with inserts releasably fitted to the curvilinear surface of the head in accordance with the present invention.
Figure 2:
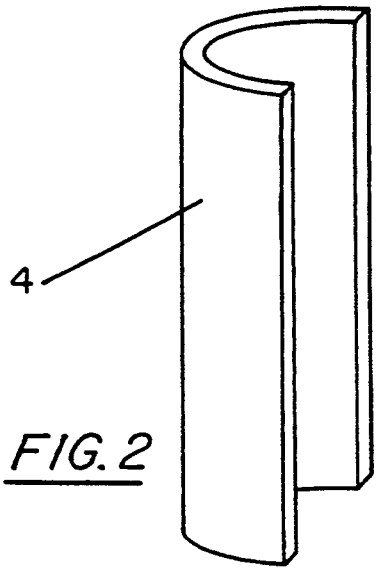
FIG. 2 is an upper side perspective view of one of the inserts used in the head shown in FIG. 1.

With reference to FIGS. 1 and 2 of the drawings, there is shown a solid head 2 with a pair of solid inserts 4 releasably secured in the cavity or curvilinear surface of the head by screws 6. The head shown is typical of a solid head used in sublimable transfer apparatus. In the embodiment shown in FIG. 1, the head, made of aluminum 6061 which is a good conductor of heat, has outside dimensions of four by four by two and three-fourths inches for each half. The cavity or the curvilinear surface of the head, with the insert removed, has a diameter of three and one-half inches. The surface of the cavity is smooth and uniform so that with the inserts removed, it can be used to make imprints on mugs having an outside diameter (O.D.) of three and three-eighths inches. In practice, there is inserted between the cavity wall and the transfer sheet a pad or sheet of silicone rubber having a wall thickness of one-eighth inch. In the embodiment of FIGS. 1 and 2, the insert 4 has a wall thickness of 0.125 inches and the O.D. is three and one-half inches so that the insert matches or mates smoothly, solidly and uniformly with the cavity of the head. The insert, as shown, is made of mild steel. Use of the foregoing inserts enables the user to print, without sacrifice of the quality of the printing, mugs having an O.D. of three and one-eighth inches even though the head cavity has a diameter of three and one-half inches. In this way, a user having only one subliminal transfer apparatus can easily adapt the apparatus to imprint mugs of varying diameters by use of inserts 4 of varying thickness. Thus, the small shopowner who typically has only one transfer apparatus, with the aid of the inserts, can economically print mugs and other cylindrically shaped objects of various diameters with subliminal dyes. Because the inserts are solid (do not give or yield under pressure), made of a flood heat conducting metal and fit smoothly and uniformly within the cavity of the head, the sublimable dye imprints are of high quality. While a range in wall thickness of the inserts of about 0.063 to 0.125 inches has been mentioned hereinabove, it should be apparent that other wall thicknesses can be used in order to adapt the head to accommodate additional sizes of mugs and the like. While the releasable fastening means to securely hold the insert in the head cavity has been shown as a screw 6, other means can be used such as a resilient L-shaped clip that is connected to the outer edge of the insert and clips over the outer wall for friction engagement therewith. The inserts 4, as shown, are made of mild steel. Other metals can be used such as aluminum alloys, brass, zinc alloys or copper. Similarly, the head can be made of steel or one of the aforementioned metals.

Figure 3:
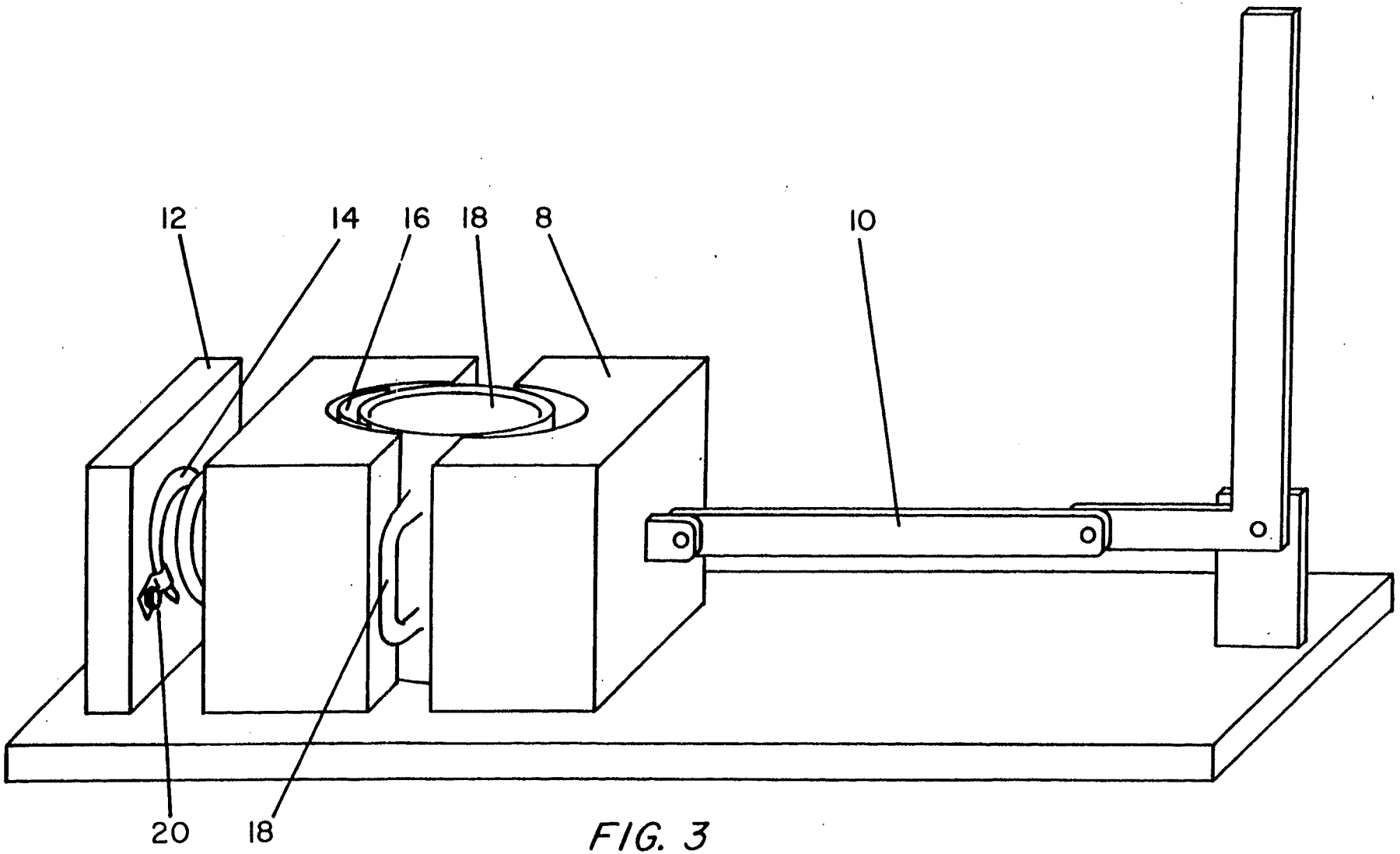
FIG. 3 is a side, upper perspective view of one embodiment of the spring tension means of the present invention.

Referring to FIG. 3, there is shown another embodiment of the present invention wherein means is provided which improves the quality of printing with sublimable dyes and improves the versatility or adaptability of the transfer apparatus. As shown, the apparatus has a two-part solid head 8, each part being movable, responsive to movement of connecting lever 10. Adjacent to and in alignment with the rear part of the head is a stop member 12 on which is centrally mounted a steel coil spring 14 which bears, centrally, against the rear wall of the head. As shown in FIG. 3, the spring is in its compressed position so that full and uniform pressure is exerted against transfer sheet 16 and mug 18. The spring can be fastened to the stop 12 using bolt 20 and like fastening means to the rear wall of the head. Other fastening means can be used such as welding or an eye bolt. In the embodiment shown, the spring is two inches long with a diameter of one inch. It has a load deflection of about 580 pounds. For each movement of the connecting lever 10 of 0.1 inch, there is applied to the transfer sheet and mug a pressure of about 116 pounds. In the molding of cylindrical objects such as mugs, because of the molding process or materials used, a given size mug such as 3½" O.D. can vary by one-sixteenth or more in its O.D. By reason of the present invention, such variations in diameter of the mugs or the like are automatically accommodated because of the adequate and uniform pressure exerted by the arrangement of the stop member 12, spring 14 and movable head 8. This advantage greatly improves the quality of the printing. In the embodiment of FIG. 3, the cavity of the head has a diameter of 3½". It, nevertheless, because of the spring pressure means, can print mugs of 3¼" down to about 3" without sacrifice of the quality of print. Additional versatility or adaptability of the apparatus can be imparted by the use of inserts 4 in the apparatus of FIG. 3.

Figure 4:
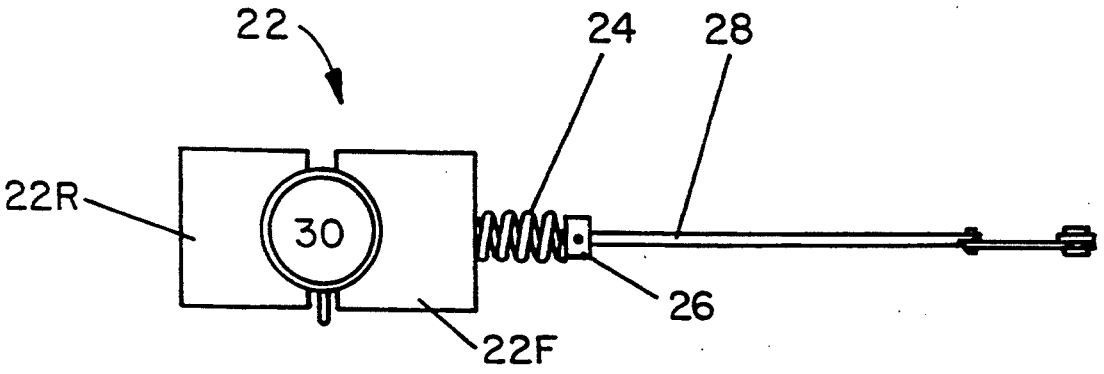
FIG. 4 is a top view of another embodiment of the spring tension means of the present invention.
Figure 5:
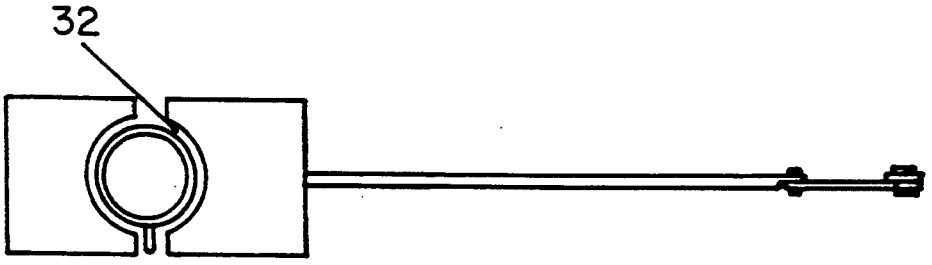
FIG. 5 is a top view of a prior art apparatus in which there is a direct connection between the head and the lever means.
Figure 6:
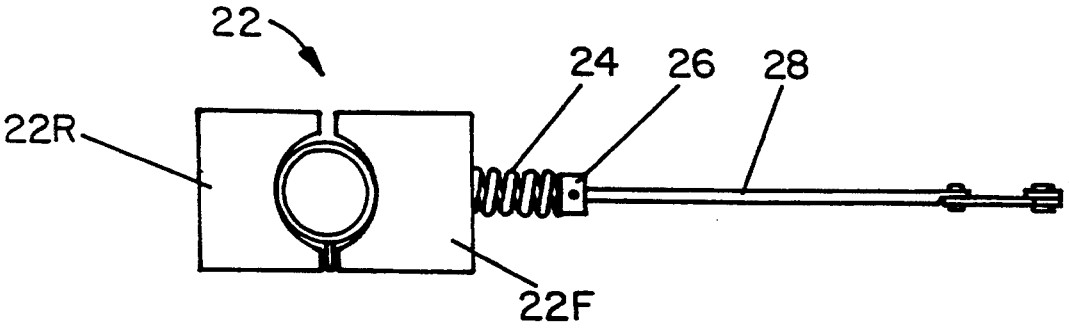
FIG. 6 is a top view of the spring tension means of FIG. 4 showing the use thereof on a mug having a smaller diameter than the mug shown in FIG. 4.

In the embodiment of the present invention shown in FIGS. 4 and 5, the transfer apparatus has a solid head 22 with a stationary rear half 22R and a movable front half 22F. On the front wall of head member 22F there is securely and centrally mounted a steel coil spring 24 which is, in turn, secured, as by bracket 26, to connecting lever 28. The inner end of spring 24 can be connected to member 22F by bolting or welding. As shown in FIG. 4, the cavity of the head has a diameter of 3½" and a coffee mug 30 is positioned therein for imprinting. The mug has an O.D. of three and three-eighth inches. Coil spring 24, as shown, is 2" long and 1" in diameter. In FIG. 4, the spring is deflected about 25% which provides a pressure of about 600 p.s.i. against the transfer sheet, silicone rubber pad and mug. In FIG. 5, there is shown a prior art apparatus having a connecting lever directly connected to the head. In this case, the mug has an O.D. of 3¼" and, as can be seen, there is a void or space 32 between the head cavity walls and the mug making it impossible to imprint the mug. In contrast thereto, the same mug (3¼" O.D.) is accommodated in the head cavity, as shown in FIG. 6, making it possible to obtain a high quality print. In both FIGS. 5 and 6, the cavity of the head has a diameter of 3½ inches. The spring pressure means shown in FIGS. 4 and 6, in addition to enhancing the adaptability of the head to imprinting mugs of different diameters, provides adequate and uniform pressure to the mug to give high quality print. In the embodiment of FIGS. 4 and 6, there can be used the inserts 4 to give the apparatus even more versatility for different size mugs.

Figure 7:
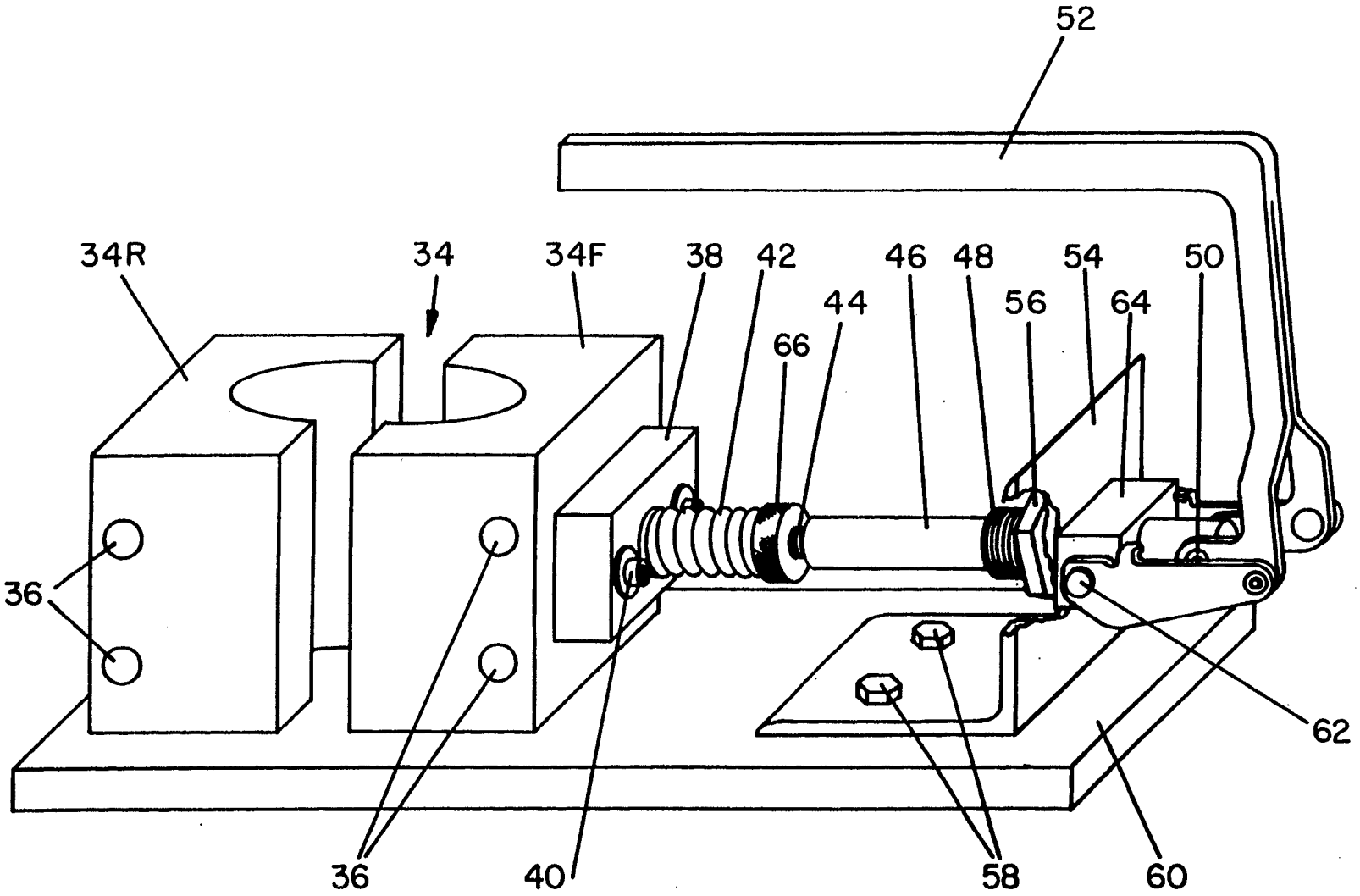
FIG. 7 is a side, upper perspective view of another embodiment of the invention.

In another embodiment of the present invention shown in FIG. 7, the solid head 34 comprises a stationary or fixed rear half 34R and a slidably movable front half 34F. The head, which is made of aluminum, is provided with electrode receiving bores 36 for heating the heads. To the front wall of the front cavity 34F is attached a block 38 as by bolts 40 or the like. In the embodiment shown, the block is centrally positioned to provide a uniform distribution of pressure on cavity 34F. The block is made of a suitable material such as Teflon which provides insulation between the heated cavity 34F and the spring coil 42 and the threaded shaft 44. The actuating means for moving cavity 34F comprises a shaft 46 which is slidably received in sleeve 48 and connected pivotally at 50 to lever 52 so that when the lever is pressed downward, cavity 34F moves toward cavity 34R. Sleeve 48 is connected to bracket 54 using, for example, nut 56. The supporting bracket 54 is securely connected by bolts or screws 58 to a supporting surface 60 such as a bench or other platform. Lever 52 is also pivotally connected at 62 to support block 64 which has a bore therethrough to slidably receive shaft 46. Threaded shaft 44, which is threadedly connected to block 38, is provided with a nut 66 that retains coil spring 42 and permits adjustment of the tension on the spring. In the embodiment shown, the spring is 2" long and has a diameter of 1". Inserts 4 can be used in this embodiment of the present invention also for greater versatility of the apparatus.

Ceramic articles are notorious for having some variation in diameter and surface condition. As a precaution, therefore, it is good practice, in order to further insure adequate and uniform distribution of pressure on, e.g., a mug, to insert a thin pad of silicone rubber between the transfer sheet and the curvilinear surface of the insert described herein or the solid head.

What is claimed is:

1. A sublimation transfer apparatus for use by the small shopowner to print mugs of various diameters with sublimal dyes which comprises:

a flat surfaced base;

a heated, two part, solid head positioned on the upper surface of said base, said head having front and rear diametrically opposed curvilinear cavities which are adapted to releasably receive and apply pressure to walls of a mug and a transfer sheet having sublimable dyes positioned between said cavities, said front cavity being slidably movable relative to said rear cavity which is stationary;

an insulation block affixed to and centrally positioned on said front cavity;

lever means having spring pressure means adjacent said front cavity whereby sufficient and uniform distribution of pressure against said front cavity, said transfer sheet and mug is obtained even though the diameter of the mug may vary, said spring pressures means being positioned between said lever means and said insulation block; and a curvilinear, metal insert which mates with and is releasably attached to each of said front and rear cavities, said inserts thereby further adapting said apparatus to receive mugs of various diameters.

* * * * *